United States Patent [19]

Berry et al.

[11] 4,024,727

[45] May 24, 1977

[54] VUILLEUMIER REFRIGERATOR WITH SEPARATE PNEUMATICALLY OPERATED COLD DISPLACER

[75] Inventors: Robert L. Berry, Palos Verdes Peninsula; Axel G. Dehne, Los Angeles, both of Calif.

[73] Assignee: Hughes Aircraft Company, Culver City, Calif.

[22] Filed: Mar. 1, 1974

[21] Appl. No.: 447,417

[52] U.S. Cl. ..... 62/6; 62/86
[51] Int. Cl. ..... F25b 9/00
[58] Field of Search ..... 62/6, 86, 467

[56] References Cited

UNITED STATES PATENTS

| | | | |
|---|---|---|---|
| 3,078,683 | 2/1963 | Dros | 62/6 |
| 3,091,092 | 5/1963 | Dros | 62/6 |
| 3,188,821 | 6/1965 | Chelbs | 62/6 |
| 3,237,421 | 3/1966 | Gifford | 62/6 |
| 3,321,926 | 5/1967 | Chellis | 62/6 |
| 3,367,121 | 2/1968 | Higa | 62/6 |
| 3,431,746 | 3/1969 | Webster | 62/6 |

OTHER PUBLICATIONS

Miniature Vuilleumier-Cycle Refrigerator, G. K. Patcher and F. K. du Pre; Advances in Cryogenic Engineering, Vol. 15, pp 447–451, Plemum Press, N. Y. London, 1970.

*Primary Examiner*—William J. Wye
*Attorney, Agent, or Firm*—Allen A. Dicke, Jr., W. H. MacAllister, Jr.

[57] ABSTRACT

The Vuilleumier refrigerator cold free piston type displacer operates on pressure pulses generated by relative heating and cooling of gas to raise and lower the pressure in the entire interconnected system. The cold displacer operates with differential areas against which the line pressure acts, and a pneumatic spring to cause reciprocation of the displacer.

3 Claims, 3 Drawing Figures

VUILLEUMIER REFRIGERATOR WITH SEPARATE PNEUMATICALLY OPERATED COLD DISPLACER

BACKGROUND OF THE INVENTION

This invention is directed to a cryogenic refrigerator, and particularly a Vuilleumier refrigerator having a pneumatically operated cold displacer.

The original Vuilleumier refrigerator was disclosed by Rudolph Vuilleumier in U.S. Pat. No. 1,275,507. He defined a structure wherein displacement of the gas in the system between volumes at different temperatures caused pressure changes and the pressure changes in turn achieved heat cycle purposes. The Vuillemumier refrigerator was adapted for minaturization by K. W. Cowans in U.S. Pat. No. Re. 27,338. A further improved structure, of greater efficiency was taught by G. P. Lagodmos in U.S. Pat. No. 3,742,719. Thus, the background includes teaching that pressure changes can be accomplished by moving refrigerant gas from one chamber to another to achieve heating and cooling. Furthermore, cycling of the refrigerant gas causes gas expansion in the space to be refrigerated, with the achievement of refrigeration. In the usual Vuillemumier structure, as evidenced by the Cowans and Logodmos patents, the hot displacer and cold displacer have been mounted in the same structure in order to achieve cyclic interrelationship so that mass transfer and heat transfer are accomplished to produce the refrigeration.

The background also includes Higa U.S. Pat. No. 3,367,121. Higa teaches in his FIG. 3, which is not an immediately apparent part of his disclosure, that the Stirling Cycle can be modified to have a separate cold cylinder in which refrigeration is produced, with the connection of the cold cylinder to the rest of the refrigeration equipment only through a single line. The line provides pressure pulses which cause reciprocation of the cold piston. The Stirling Cycle has the disadvantage that pressure seals are required in the pressure pulse generating equipment. Such seals wear and tend to lose effectiveness to reduce the life of the equipment.

SUMMARY OF THE INVENTION

In order to aid in the understanding of this invention it can be stated in essentially summary form that it is directed to a Vuilleumier Refrigerator which has a separate pneumatically operated cold displacer to produce cryogenic refrigeration. The refrigerator has a hot volume, a warm volume and a cold volume. There are two structures, one the thermal pulse generator and the other, the expander. The warm volume is divided between the thermal pulse generator and the expander. Pulses from the pulse generator cause reciprocation of the expander displacer to in turn cause refrigeration and cooldown thereof.

It is thus an object of this invention to provide a Vuillemumier refrigerator wherein the refrigeration is produced in a separate structure from the thermal pulse compressor. It is a further object to provide a Vuillemumier refrigerator wherein refrigeration is produced by pulses thru a single line, so that the refrigeration expander can be mounted on a gimbal or the like, to reduce the number of required connections. It is a further object of this invention to provide a refrigerator which is economic of construction and easy to use and is particularly desirable for producing refrigeration with a single reciprocating displacer at the refrigeration load.

Other objects and advantages of this invention will become apparent from a study of the following portions of this specification, the claims and the attached drawings.

DESCRIPTION OF THE PREFERRED EMBODIMENT

Figure 1:
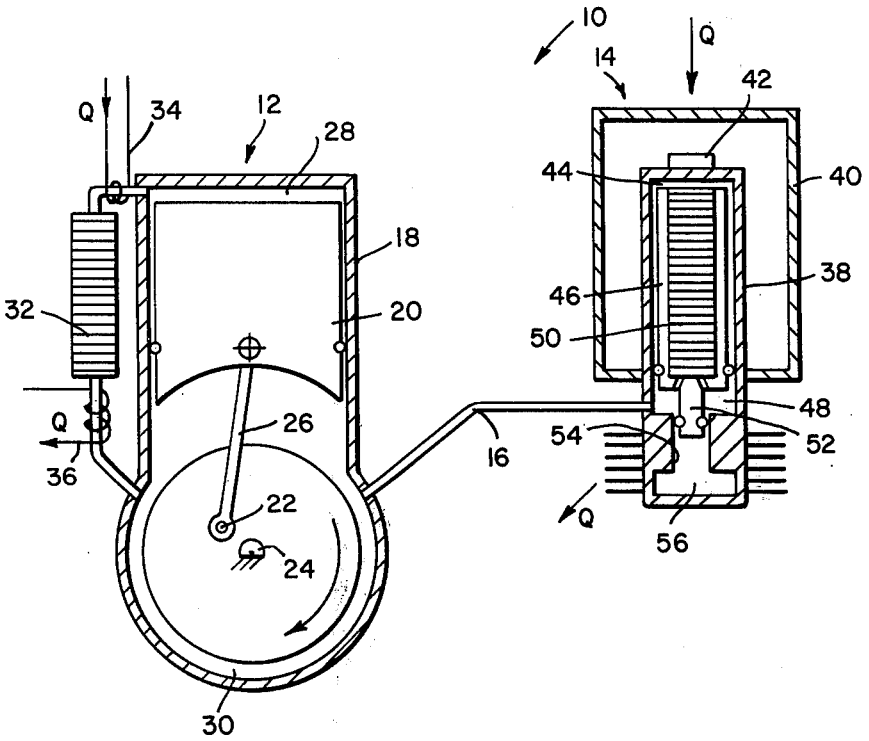
FIG. 1 is a schematic section of the Vuilleumier refrigerator with separate pneumatically operated cold displacer, in accordance with this invention.

A sectional schematic of the Vuillemumier refrigerator of this invention is generally indicated at 10 in FIG. 1. The refrigerator comprises thermal pulse generator 12 and an expander 14 connected together by a single pulse tube 16.

Thermal pulse generator 12 comprises hot cylinder 18 in which reciprocates. displacer 20 rediprocates. Crank 22 rotating on center 24 and carrying connecting rod 26 causes reciprocation of displacer 20 with rotation of the crank.

Displacer 20 divides the cylinder volume and the adjacent crank case into hot volume 28 and warm volume 30. Regenerator 32 is connected to both of these volumes. Regenerator 32 may be external, as shown, or can be internal in the hot displacer 20. Since there is no pressure drop across the displacer, except the pressure drop due to flow thru regenerator 32, the displacer can be sealed to the cylinder wall with rider rings which minimize friction and wear. If the annulus between the cylinder wall 18 and the displacer wall 20 is used as the regenerator no seal is needed. Heat is introduced at heat input 34. Preferably, the heat input is a heater in direct association with the cylinder head over the hot volume. It can be an electric coil embeded into the hot end of the hot cylinder. Heat output 36 is an output to the ambient environment, such as to the adjacent air, or to cooling water or the like. Heat output 36 represents heat output from the entire warm volume 30, and thus the entire crankcase can be covered with cooling coils. Warm volume 30 is thus sufficiently above the ambient to reject heat to the ambient.

Expander 14 includes a cold cylinder 38 having insulation housing 40 therein. Device 42 is mounted upon the cold cylinder head above cold volume 44. Device 42 can be an infrared detector or the like, with the housing 40 provided with window so that it can receive its radiation.

Cold displacer 46 reciprocates within cold cylinder 38. It divides cylinder 38 into the cold volume 44 and warm volume 48. Warm volume 48 is connected to warm volume 30 by means of pulse tube 16. Warm volume 48 is connected to cold volume 44 through regenerator 50. In the illustrated structure of the expander, the regenerator is positioned interiorly of the displacer, but can be external if desired. The area of cold displacer 46 facing warm volume 48 is reduced by means of spring piston 52 which acts in spring cylinder 54. Spring cylinder 54 includes a gas volume 56. Gas volume 56 is charged with the same refrigerant gas as the remainder of the system and is at the mean pressure of warm volume 48. Thus, leakage past the seals on spring piston 52 maintain the pressure in spring gas volume 56 at the mean pressure of volume 48.

Figure 3:
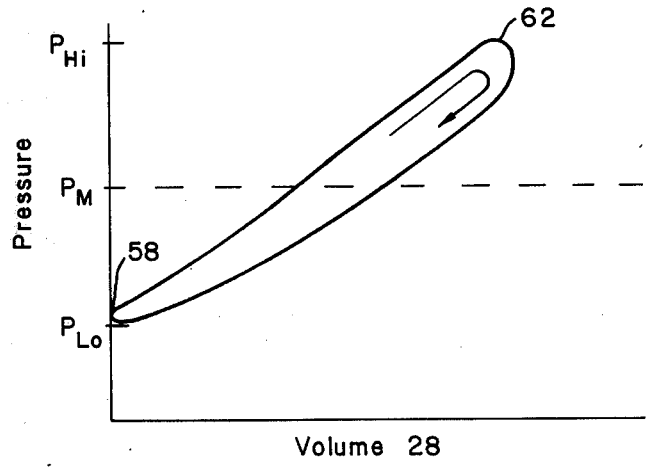
FIG. 3 is a pressure versus volume diagram of the hot stroked volume.

Considering first the operation of thermal pulse generator 12, motion of displacer 20 causes refrigerant gas to be cycled between the hot volume 28 and warm volume 30. This cyclic change in temperature of a fixed volume of gas results in a cyclic change in pressure. FIG. 3 illustrates the PV diagram of the hot volume 28 and illustrates that when the volume is large the system pressure is high. Since hot displacer 20 is driven by a simple crank, the motion of the hot displacer and the pressure waves generated are essentially sinusoidal. These pressure changes are transmitted via the pulse tube or gas transfer line 16 to the cold cylinder and expander assembly 14. Pressure pulsing and gas flow are utilized at the expander to produce refrigeration at the cold end and to reject heat at the ambient end.

Figure 2:
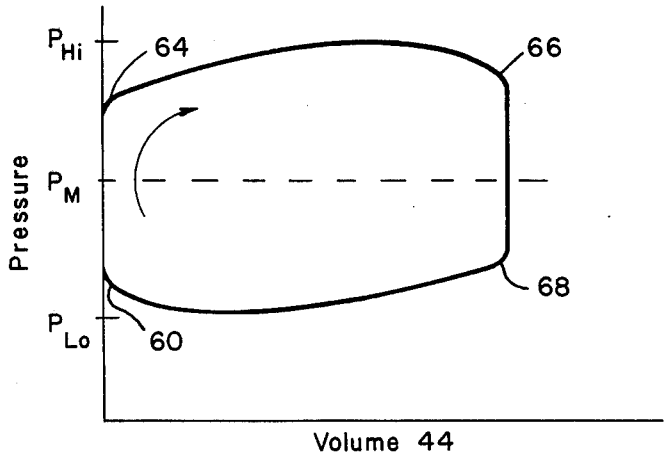
FIG. 2 is a diagram of pressure versus volume of the cold stroked volume.

In the expander 14, when the cyclic pressure in the refrigerant spaces including the cold volume 44 and warm volume 48 is low, the pneumatic spring force of the pressure in the gas volume 56 on spring piston 52 acts on the cold displacer 46 to move the displacer upward to reduce the cold volume 44. When the cyclic refrigerant gas pressure is high the balance of forces causes the cold displacer to move to increase cold volume 44. The PV diagram for cold volume 44 is shown in FIG. 2. By expanding longer quantities of high pressure gas and compressing smaller quantities of low pressure gas in the cold stroked volume 44, net cooling effect is produced over the complete cycle.

Considering the cycle as a whole, with the hot displacer 20 at the hot end, there is minumum hot volume 28. Most of the refrigerant gas is in the ambient temperature volumes and the pressure of the system tends toward a minimum. With minimum pressure throughout the system, except for the pneumatic spring volume which is always at mean pressure, there is a net force upon the cold displacer tending to hold the cold displaced volume at a minimum. This is at points 58 and 60 at FIGS. 3 and 2. As the crank rotates, the hot displacer moves to the ambient end with a displacement of ambient temperature gas from ambient volume 30 into hot volume 28. The system pressure rises toward point 62 in FIG. 3. With the increase in pressure, there is a net force acting on cold displacer 46 to hold the cold stroked volume 44 small until the pressure in the system is equal to the mean pressure, illustrated by dotted lines in FIGS. 2 and 3. Above that pressure, there is a net force on the displacer 46 tending to drive it in a direction to increase the cold expansion volume 44. The frictional force of the seals on cold displacer 46 tends to resist expander displacer motion. Furthermore, pressure drop through the regenerator 50 tends to hold the displacer toward the cold volume. Thus, these forces are not overcome until point 64 is reached in FIG. 2, and then the relative forces permit displacer motion to increase cold volume 44, to point 66. Passage of the refrigerant gas through regenerator 50 to the cold volume cools the gas to reduce the net pressure in the system. This causes the downward curvature of pressure between points 64 and 66 of FIG. 2. This begining of the expansion starts the refrigeration developed in the cold end.

The hot displacer 20 moves from point 62 to point 58 causing a reduction in pressure in the system. In FIG. 2 this is a reduction in pressure from point 66 to point 68. This expansion in cold volume 44 produces the refrigeration. As the pressure moves down the line from point 66 to point 68 it crosses the mean pressure line. At that point, the pressure forces change to cause a net force which urges cold displacer 46 to reduce cold volume 44. Again, however, the seal drag and the pressure drop due to flow through the regenerator 50 tend to maintain the cold displacer in position until the pressure is reached at point 68 where the system pressure reaches sufficent differential to cause motion of the cold displacer from point 68 to point 60. Now the system is back to the begining point. It is noted that as the system pressure of the refrigerant gas increases, the compression of gas in volume 48 causes an increase in temperature so that the refrigeration thermal load is principally rejected at the warm end of the expander structure.

Thus refrigeration is produced. The use of a thermal pulse generator 12 causes reciprocation of the expander displacer without the need for significant seals on the hot displacer which need resist pressure drop therecross. The pressure is substantially the same on both sides of the hot displacer at all times, except for pressure drop due to flow through the hot regenerator. In view of the fact that temperature in the hot volume 28 averages about 1200°F degrees and is a maximum about 1350°F degrees, the elimination of seals subjected to temperatures of this order appreciably increases the useful life of this system.

This invention having been described in its preferred embodiment, is clear that it is susceptible to numerous modifications and embodiments within the ability of those skilled in the art and without the exercise of the inventive faculty. Accordingly, the scope of this invention is defined by the scope of the following claims.

What is claimed is:

1. A cryogenic refrigerator comprising;

a cold cylinder having a cold end and having a cold cylinder area, a displacer reciprocably mounted within said cold cylinder and separating said cold cylinder into a cold volume at the cold end of said cold cylinder and a warm volume at the other end thereof, said displacer having a smaller area at said warm volume than said cold volume, a regenerator connected between said warm volume and said cold volume and a pneumatic spring for urging said cold displacer toward both the cold and the warm ends of said cold cylinder, said displacer being freely reciprocable in said cold cylinder except for said pneumatic spring and pressure in said cold and warm volumes acting on the differential area of said displacer facing said cold volume and said warm volume, the improvement comprising:

a thermal pulse generator connected to said warm volume of said cold cylinder for providing pressure pulses for causing reciprocation of said cold displacer in said cold cylinder, said thermal pulse generator comprising:

a hot cylinder having a hot end and a warm end, a displacer reciprocapably mounted in said hot cylinder for separating said hot cylinder into a hot volume and a warm volume, said warm volume of said thermal pulse generator being connected to said warm volume of said cold cylinder, a regenerator connected between said hot volume and said warm volume and means for heating the hot end of said hot cylinder, refrigerant gas in said volumes, said refrigerant gas increasing in pressure in all of said volumes as said hot displacer displaces refrigerant gas into said hot volume and decreasing in pressure as said hot displacer displaces gas out of said hot volume into said warm volume.

2. The cryogenic refrigerator of claim 1 further including means to reciprocate said hot displacer within said hot cylinder.

3. The cryogenic refrigerator of claim 2 wherein said means for reciprocating said hot displacer in said hot cylinder comprises a crank and a connecting rod interconnected between said crank and said hot displacer so that motion of said crank causes reciprocation of said hot displacer.

* * * * *